US010932048B2

(12) United States Patent
Song et al.

(10) Patent No.: US 10,932,048 B2
(45) Date of Patent: Feb. 23, 2021

(54) SPEAKER

(71) Applicant: AAC Technologies Pte. Ltd., Singapore (SG)

(72) Inventors: Wei Song, Shenzhen (CN); Fan Zhang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/527,077

(22) Filed: Jul. 31, 2019

(65) Prior Publication Data

US 2020/0045442 A1 Feb. 6, 2020

(30) Foreign Application Priority Data

Aug. 4, 2018 (CN) ..... 201821255510.3

(51) Int. Cl.

| | |
|---|---|
| ***H04R 9/02*** | (2006.01) |
| ***H04R 7/20*** | (2006.01) |
| ***H04R 9/06*** | (2006.01) |
| ***H04R 9/04*** | (2006.01) |

(52) U.S. Cl.

CPC ..... *H04R 9/025* (2013.01); *H04R 7/20* (2013.01); *H04R 9/043* (2013.01); *H04R 9/045* (2013.01); *H04R 9/06* (2013.01); *H04R 2499/11* (2013.01)

(58) Field of Classification Search

CPC . H04R 7/16; H04R 7/20; H04R 9/025; H04R 9/043; H04R 9/045; H04R 9/046; H04R 9/066; H04R 2307/207; H04R 2499/15; H04R 9/06; H04R 2499/11

USPC ..... 381/396, 403, 404, 405, 407, 409, 410, 381/412, 431

See application file for complete search history.

(56) References Cited

U.S. PATENT DOCUMENTS

| | | | | |
|---|---|---|---|---|
| 6,618,487 | B1 * | 9/2003 | Azima | H04R 1/24 381/152 |
| 10,250,993 | B1 * | 4/2019 | Xiao | H04R 9/06 |
| 2001/0026625 | A1 * | 10/2001 | Azima | H04R 7/045 381/152 |

* cited by examiner

*Primary Examiner* — Huyen D Le
(74) *Attorney, Agent, or Firm* — W&G Law Group LLP

(57) ABSTRACT

The present disclosure provides a speaker, including a housing, and a vibration unit and a magnetic circuit unit that are received in the housing. The vibration unit includes a voice coil and a flexible circuit board electrically connected to the voice coil. An adhesive layer is provided at a position where the flexible circuit board is connected to the voice coil. The speaker of the disclosure is provided with an adhesive layer at a position where the flexible circuit board is connected with the voice coil, thereby making it possible to increase the adhesive force of the voice coil and the flexible circuit board using the provided adhesive layer, reduce risk of reliable separation, increase the service life of the speaker, reduce the maintenance cost of the speaker, and increase the economic benefits.

11 Claims, 2 Drawing Sheets

SPEAKER

TECHNICAL FIELD

The present disclosure relates to the field of acoustic design technology, and in particular, to a speaker.

BACKGROUND

In the related art, a speaker includes a housing and a vibration unit and a magnetic circuit unit that are received in the housing. The vibration unit includes a voice coil and a flexible circuit board electrically connected to the voice coil, and in this structure, an adhesive is usually adopted to fixedly connect the voice coil with the flexible circuit board.

However, as for the speaker in the related art, when the flexible circuit board is bonded to the voice coil, the bonding area is limited, so that it is easy for the flexible circuit board to be separated from the voice coil, thereby resulting in a malfunction of the speaker or a change in performance.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present disclosure will be further illustrated with reference to the accompanying drawings and the embodiments.

Figure 1:
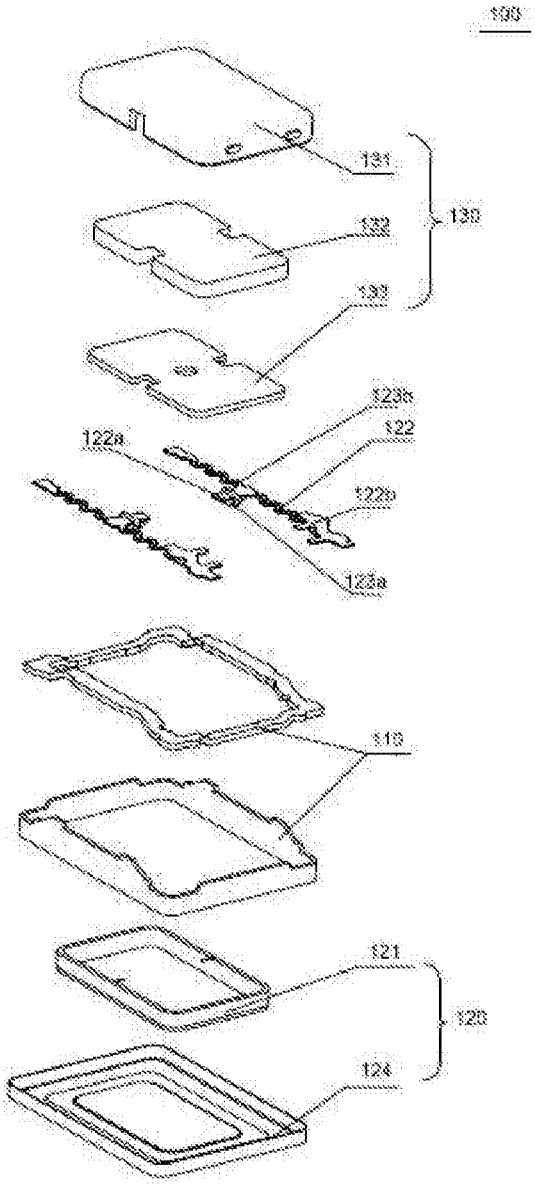
FIG. 1 is an exploded diagram of a speaker of the present disclosure.
Figure 2:
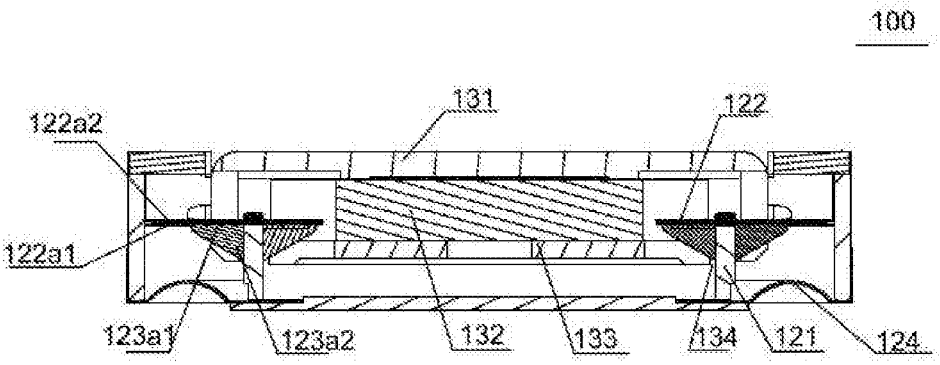
FIG. 2 is a cross sectional diagram of a speaker of the present disclosure.
Figure 3:
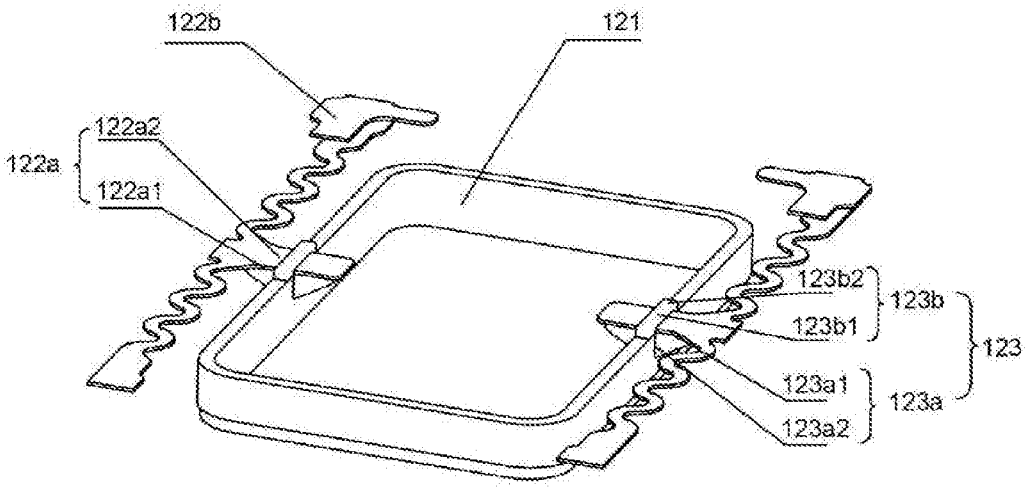
FIG. 3 is a structural schematic diagram of a speaker of the present disclosure in which only a flexible circuit board and a voice coil are shown.

As shown in FIG. 1 to FIG. 3, the present disclosure relates to a speaker 100. The speaker 100 includes a housing 110, and a vibration unit 120 and a magnetic circuit unit 130 that are received in the housing 110. The vibration unit 120 includes a voice coil 121 and a flexible circuit board 122 electrically connected to the voice coil 121. As shown in FIG. 1, an adhesive layer 123 is provided at a position where the flexible circuit board 122 is connected to the voice coil 121.

Specifically, as shown in FIGS. 2 and 3, the flexible circuit board 122 is located at an end of the voice coil 121 (top in FIG. 2). The adhesive layer 123 may be provided on a lower surface of the flexible circuit board 122 in contact with the voice coil 121, and the adhesive layer 123 may also be provided on an upper surface of the flexible circuit board 122 in contact with the voice coil 121. Alternatively, the two contact surfaces are each provided with the adhesive layer 123, and the like. However, regardless of the arrangement manner of the adhesive layer 123, it should be bonded to the flexible circuit board 122 and the voice coil 121 concurrently, so that it is possible to use the provided adhesive layer 123 to increase the adhesive force of the flexible circuit board 122 and the voice coil 121, reduce risk of reliable separation, increase the service life of the speaker 100, reduce the maintenance cost of the speaker 100, and increase the economic benefits.

The speaker 100 in the present embodiment is provided with the adhesive layer 123 at a position where the flexible circuit board 122 is connected to the voice coil 121, thereby making it possible to use the provided adhesive layer 123 to increase the adhesive force of the voice coil 121 and the flexible circuit board 122, reduce risk of reliable separation, increase the service life of the speaker 100, reduce the maintenance cost of the speaker 100, and increase the economic benefits.

Specifically, as shown in FIG. 2 and FIG. 3, the flexible circuit board 122 includes a connecting portion 122*a* and a lead terminal 122*b* connected to the connecting portion 122*a*. The connecting portion 122*a* is electrically connected to the voice coil 121, and the adhesive layer 123 is provided at a position where the connecting portion 122*a* is connected to the voice coil 121.

Specifically, as shown in FIG. 3, the adhesive layer 123 includes a first adhesive layer 123*a* and a second adhesive layer 123*b*. The connecting portion 122*a* includes a first surface 122*a*1 facing the voice coil 121 and a second surface 122*a*2 facing away from the voice coil 121. The first surface 122*a*1 is provided with a first adhesive layer 123*a*, and the second surface 122*a*2 is provided with a second adhesive layer 123*b*. Namely, the upper and lower surfaces of the connecting portion 122*a* (such as the upper and lower surfaces in FIG. 3), i.e., the front and back surfaces, are each provided with the adhesive layer 123, which are respectively the first adhesive layer 123*a* and the second adhesive layer 123*b*. In this way, it is possible to further use the provided first adhesive layer 123*a* and second adhesive layer 123*b* to increase the adhesive force of the voice coil 121 and the flexible circuit board 122, reduce risk of reliable separation, increase the service life of the speaker 100, reduce the maintenance cost of the speaker 100, and increase the economic benefits.

As shown in FIG. 3, the first adhesive layer 123*a* includes a first bonding portion 123*a*1 and a second bonding portion 123*a*2 fixedly connected to the first bonding portion 123*a*1. The first bonding portion 123*a*1 is bonded to the first surface 122*a*1, and the second bonding portion 123*a*2 is bonded to the voice coil 121.

Specifically, as shown in FIG. 2 and FIG. 3, a longitudinal section of the first adhesive layer 123*a* may be a right triangle. Thus, it corresponds to that the first adhesive layer 123*a* similar to a stiffener is provided between the first surface 122*a*1 of the flexible circuit board 122 and the voice coil 121, thereby making it possible to increase the adhesive force of the flexible circuit board 122 and the voice coil 121, reduce risk of reliable separation, increase the service life of the speaker 100, reduce the maintenance cost of the speaker 100, and increase the economic benefits. Without doubt, in addition to this, the longitudinal section of the first adhesive layer 123*a* may have other shapes.

As shown in FIG. 2 and FIG. 3, in order to further improve the adhesive force between the flexible circuit board 122 and the voice coil 121, the first surface 122*a*1 is provided with two first adhesive layers 123*a*, and the two first adhesive layers 123*a* are respectively provided on two sides of the voice coil 121 (for example, as shown in FIG. 2, two first adhesive layers 123*a* are provided on the left and right sides of the voice coil 121).

As shown in FIG. 2 and FIG. 3, in order to further improve the adhesive force between the flexible circuit board 122 and the voice coil 121, the second adhesive layer

123*b* includes a third bonding portion 123*b*1 and a fourth bonding portion 123*b*2 fixedly connected to the third bonding portion 123*b*1. The third bonding portion 123*b*1 is bonded to the second surface 122*a*2, and the fourth bonding portion 123*b*2 is bonded to the voice coil 121. Namely, as shown in FIG. 1, the second adhesive layer 123*b* is located at the top of the flexible circuit board 122 and includes a portion overlapping the flexible circuit board 122 (i.e., the third bonding portion 123*b*1) and a portion extending beyond the flexible circuit board 122 to a portion that is connected to the voice coil 121 (i.e., the fourth bonding portion 123*b*2).

As shown in FIG. 1 and FIG. 2, the magnetic circuit unit 130 includes a magnetic frame 131, and a main magnet 132 and a pole plate 133 which are sequentially provided in the magnetic frame 131. There is a magnetic gap 134 provided between the magnetic frame 131 and each of the main magnet 132 and the pole plate 133, and the voice coil 121 is inserted in the magnetic gap 134.

As shown in FIGS. 1 and 2, the vibration unit 120 further includes a voice diaphragm 124, and the voice diaphragm 124 is connected to the voice coil 121.

What has been described above is only an embodiment of the present disclosure, and it should be noted herein that one ordinary person skilled in the art can make improvements without departing from the inventive concept of the present disclosure, but these are all within the scope of the present disclosure.

What is claimed is:

1. A speaker, comprising:

a housing;

a vibration unit received in the housing; and a magnetic circuit unit received in the housing, wherein the vibration unit comprises a voice coil and a flexible circuit board electrically connected to the voice coil, and an adhesive layer is provided at a position where the flexible circuit board is connected to the voice coil;

wherein the flexible circuit board comprises a connecting portion and a lead terminal connected to the connecting portion, the connecting portion being electrically connected to the voice coil, and the adhesive layer being provided at a position where the connecting portion is connected to the voice coil;

wherein the adhesive layer comprises a first adhesive layer and a second adhesive layer, the connecting portion including a first surface facing towards the voice coil and a second surface facing away from the voice coil, the first surface being provided with the first adhesive layer, and the second surface being provided with the second adhesive layer;

wherein the first adhesive layer comprises a first bonding portion and a second bonding portion fixedly connected to the first bonding portion, the first bonding portion being bonded to the first surface, and the second bonding portion being bonded to the voice coil.

2. The speaker as described in claim 1, wherein a longitudinal section of the first adhesive layer is a right triangle.

3. The speaker as described in claim 2, wherein the magnetic circuit unit includes a magnetic frame, and a main magnet and a pole plate that are sequentially provided in the magnetic frame, and a magnetic gap is provided between the magnetic frame and each of the main magnet and the pole plate, the voice coil being inserted in the magnetic gap.

4. The speaker as described in claim 2, wherein the vibration unit further comprises a voice diaphragm, and the voice diaphragm is connected to the voice coil.

5. The speaker as described in claim 1, wherein two first adhesive layers are provided on the first surface, and the two first adhesive layers are provided on two sides of the voice coil.

6. The speaker as described in claim 5, wherein the magnetic circuit unit includes a magnetic frame, and a main magnet and a pole plate that are sequentially provided in the magnetic frame, and a magnetic gap is provided between the magnetic frame and each of the main magnet and the pole plate, the voice coil being inserted in the magnetic gap.

7. The speaker as described in claim 5, wherein the vibration unit further comprises a voice diaphragm, and the voice diaphragm is connected to the voice coil.

8. The speaker as described in claim 1, wherein the second adhesive layer comprises a third bonding portion and a fourth bonding portion fixedly connected to the third bonding portion, the third bonding portion being bonded to the second surface, and the fourth bonding portion being bonded to the voice coil.

9. The speaker as described in claim 8, wherein the magnetic circuit unit includes a magnetic frame, and a main magnet and a pole plate that are sequentially provided in the magnetic frame, and a magnetic gap is provided between the magnetic frame and each of the main magnet and the pole plate, the voice coil being inserted in the magnetic gap.

10. The speaker as described in claim 1, wherein the magnetic circuit unit includes a magnetic frame, and a main magnet and a pole plate that are sequentially provided in the magnetic frame, and a magnetic gap is provided between the magnetic frame and each of the main magnet and the pole plate, the voice coil being inserted in the magnetic gap.

11. The speaker as described in claim 1, wherein the vibration unit further comprises a voice diaphragm, and the voice diaphragm is connected to the voice coil.

* * * * *